US007959027B2

(12) United States Patent
Weber

(10) Patent No.: US 7,959,027 B2
(45) Date of Patent: Jun. 14, 2011

(54) PRESSURIZED CONTAINER

(75) Inventor: Norbert Weber, Sulzbach/Saar (DE)

(73) Assignee: Hydac Technology GmbH, Sulzbach/Saar (DE)

( * ) Notice: Subject to any disclaimer, the term of this patent is extended or adjusted under 35 U.S.C. 154(b) by 294 days.

(21) Appl. No.: 12/085,896

(22) PCT Filed: Sep. 26, 2006

(86) PCT No.: PCT/EP2006/009331

§ 371 (c)(1),
(2), (4) Date: Jun. 2, 2008

(87) PCT Pub. No.: WO2007/085276

PCT Pub. Date: Aug. 2, 2007

(65) Prior Publication Data

US 2010/0258573 A1 Oct. 14, 2010

(30) Foreign Application Priority Data

Jan. 25, 2006 (DE) ..... 10 2006 004 121

(51) Int. Cl.
*F17C 1/06* (2006.01)

(52) U.S. Cl. ..... 220/588

(58) Field of Classification Search ..... 220/588, 220/586, 581, 62.22, 62.19, 62.11, FOR. 126, 220/FOR. 127, 601; 206/0.6, 524.2, 524.6, 206/524.3, 524.1; *F17C 1/16, 1/06*
See application file for complete search history.

(56) References Cited

FOREIGN PATENT DOCUMENTS

| | | | | |
|---|---|---|---|---|
| DD | 121 538 | | | 8/1976 |
| DE | 690 07 165 | T2 | | 3/1994 |
| DE | 195 26 154 | C2 | | 4/1997 |
| DE | 197 51 411 | C1 | | 1/1999 |
| EP | 0 550 951 | A1 | | 7/1993 |
| EP | 0 664 418 | A1 | | 7/1995 |
| EP | 1 248 929 | B1 | | 10/2002 |
| FR | 2 301 746 | A1 | | 9/1976 |
| GB | 2 419 381 | A | | 4/2006 |
| JP | 2006242247 | A | * | 9/2006 |
| JP | 2006250172 | A | * | 9/2006 |
| JP | 2006283968 | A | * | 10/2006 |
| WO | WO 01/31252 | A1 | | 5/2001 |
| WO | WO 01/31253 | A1 | | 5/2001 |
| WO | WO 03/069217 | A2 | | 8/2003 |

* cited by examiner

*Primary Examiner* — Anthony Stashick
*Assistant Examiner* — Robert J Hicks
(74) *Attorney, Agent, or Firm* — Roylance, Abrams, Berdo & Goodman, LLP

(57) ABSTRACT

A pressurized container includes two plastic casings (12, 14) and produces a leakproof container or storage arrangement which is economical to produce. A gap opening (24) between the casings (12, 14) extends up to a point at which the casings (12, 14) are positioned together in a coaxial manner. An external support ring (22) with a wedge-shaped tapering (26) extends to that point and is embodied as an individual piece or has at least two metal, ring-shaped individual segments (28, 30).

10 Claims, 1 Drawing Sheet

PRESSURIZED CONTAINER

FIELD OF THE INVENTION

The invention relates to a pressurized container for holding at least one fluid medium, with a first plastic casing and a second plastic casing at least partially encompassing the first plastic casing. The first plastic casing at least on its one end has a collar part having an opening for the delivery and discharge of the medium. The collar part and the first plastic casing are supported on an interposed outside support ring tapering in the manner of a wedge in the direction of the gap opening between the first and second casings.

BACKGROUND OF THE INVENTION

EP 1 248 929 B1 discloses a plastic core container reinforced with a fiber plastic composite as the inner plastic casing for storing liquid and/or gaseous media under pressure. The core container has one or more fittings in the neck part and/or the bottom part and/or the cylindrical container part. At least one fitting is made to hold a screw-on pressure line feed having a cylindrical or conical thread, such as, for example, a valve or a pipeline connection. In the connection shank of the plastic core container, a cylindrical insert with one collar end extending peripherally or enveloping on the end of the connecting shank is mounted as the collar part. At least two seals are arranged such that at least one seal is located between the insert and the inside surface of the plastic connection shank of the plastic core container. At least one other seal is located between the insert and pressure line supply. This arrangement ensures a high level of long-lasting tightness on the fitting even under extreme cyclic thermal and mechanical operating stresses. Due to the sharp deflection site of the first inner plastic casing in the direction of the collar part by approximately 90°, it cannot be precluded that as a result of the sharp deflection site harmful stress peaks will occur. Although the outside support ring between the outer and inner plastic casing within the gap opening formed thereby tapers conically or in the manner of a wedge to the outside, the resulting support takes place only within the essentially horizontally running contact region of the two plastic casings. Relative movements able to damage the plastic can occur between the casings in that indicated region during operation of the device.

DE 197 51 411 C1 discloses a generic composite pressurized container for storage of gaseous media under pressure with a plastic liner as the inner or first plastic casing. Two neck pieces are located in the neck region. A winding of a fiber composite material reinforces the liner as the second plastic casing. In the neck piece holding the gas check valve, a clamp ring can be screwed into this neck piece. On the outer casing, the clamping has a threaded section adjoined by an unthreaded, truncated cone-like section. The annular groove located between the internal threaded sections of the neck piece for holding a gasket extends radially into the neck piece and on the outside of the respective neck piece. In the region adjoining the collar, the arrangement is provided with at least one bead extending radially to the outside over the entire periphery. Likewise, as in the above aforementioned solution, the wedge-like taper of the outside support ring extends only along the inner peripheral region on the neck piece along a horizontal plane which is formed by the liner and which in this respect, is deflected in turn at a sharp right angle and ends in the collar part encompassing the delivery and discharge of the medium. The solution, which in turn seals very effectively for its implementation, uses correspondingly great technical effort with several components.

SUMMARY OF THE INVENTION

An object of the invention is to provide an improved and highly reliable pressurized container formed in an economical manner at a reduced production cost.

This object is basically achieved by a pressurized container where the gap opening between the casings is routed as far as the site at which the casings are in contact with one another in a coaxial arrangement. The wedge-like taper of the outside support ring is made in one piece or is composed of at least two annular individual metal segments, and leads as far as this site. A tight container or accumulator arrangement is formed which can be implemented with low production costs.

The pressurized container according to the invention can be used for a plurality of applications. In that support takes place into the outer peripheral region of the two casings by an outside support ring tapering in the manner of a wedge, relative movements which may occur between the plastic casings are accommodated by the outside support ring. Damaging delamination processes directly between the sensitive plastic materials are avoided in this way. The contour surfaces of the first and second plastic casing facing one another can be implemented based on the wedge-like routing of the outside support ring leading into the outer peripheral region of the arrangement without sharp deflections and without sudden changes of direction. This structure enables especially careful delivery of force for the plastic casings.

The delivery of force is especially favorable when the outside support ring is made in one piece and preferably is of a plastically deformable plastic material, especially of a polymer material. Good results can, however, also be achieved when the outside support ring as a rigid support part body is composed of at least two individual segments, for example, in the manner of individual rings. This structure in turn simplifies production and therefore helps reduce production costs. If in this connection the outside support ring is completely and therefore integrally of plastic material, it is precluded that the plastic material of the casings can be damaged on the sharp-edged transition sites. For a metal individual ring-segment execution, conversely high stiffness for the container arrangement is achieved especially with respect to the collar part of the liner as the inner or first plastic material.

In one preferred embodiment of the pressurized container according to the invention, the outside contour of the outside support ring in the direction of the gap opening is provided with a convex curvature. Its opposite inside contour, proceeding from the gap opening, is allowed to extend in a straight slope which, at the site of the entry of the collar part, ends in a contact surface parallel to the longitudinal axis of the container. This configuration of the outside support ring with a convex curvature on the outside contour and a plane-parallel configuration on the inside contour side leads to an especially favorable delivery of the force of the loads of the inside casing into the outside support ring which, in this respect, is further supported by the outer plastic casing by winding.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
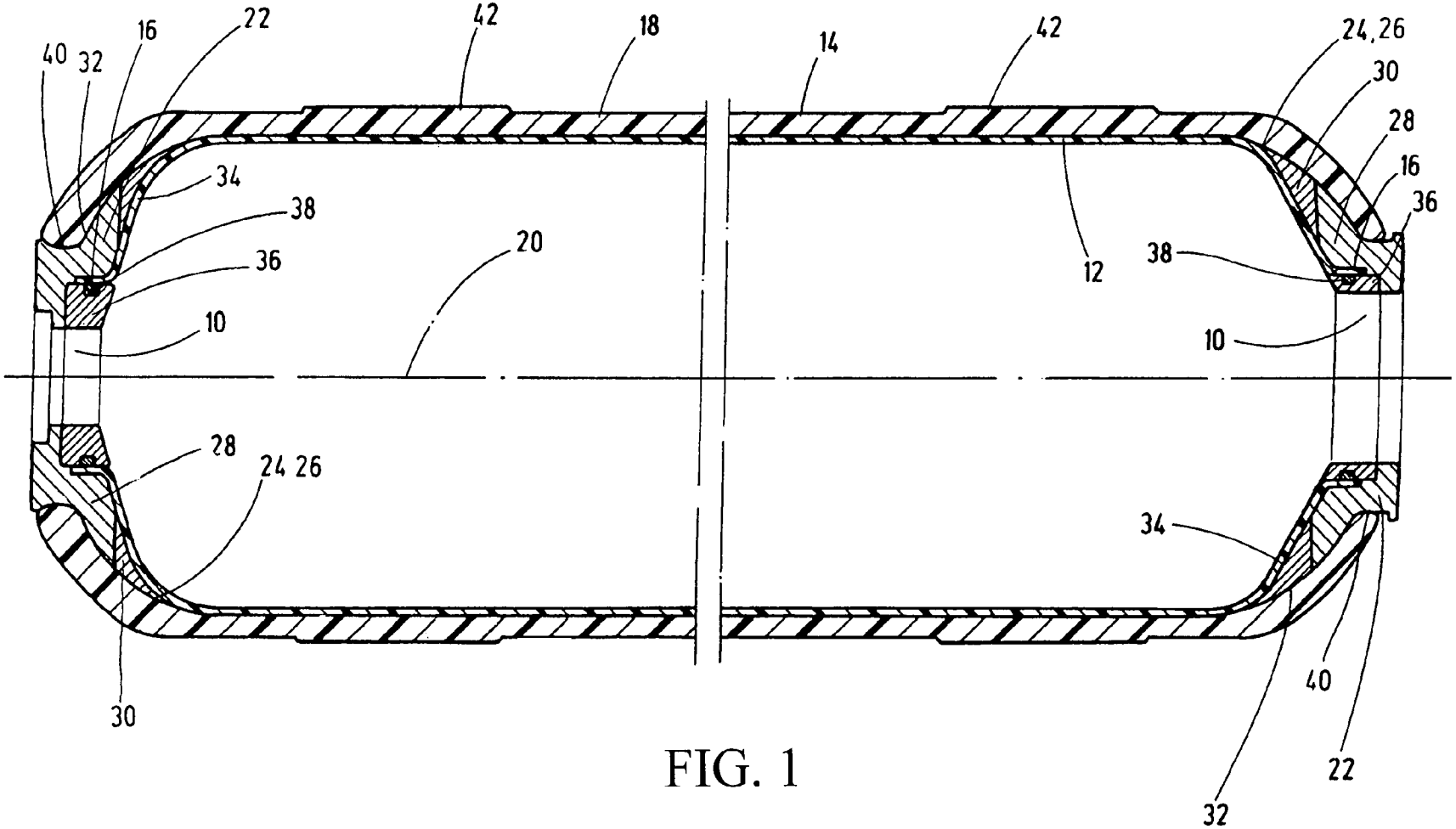
FIG. 1 is a side elevational view in section of a pressurized container according to an exemplary embodiment of the invention, schematically and not to scale.

The pressurized container shown in FIG. 1 is used to store liquid or gaseous fluid media under a pressure of up to several thousand bar. It is provided on both ends with connection openings 10 for delivery and discharge of media to which pressure lines and/or valves (not shown) can be connected and which, depending on the application, can be made and dimensioned differently for the pressurized container.

The pressurized container has a first plastic casing or liner 12 and a second plastic casing 14 at least partially surrounding the first plastic casing 12. This first plastic casing 12 is also referred to as a plastic core container or liner in the jargon of the trade. It preferably is formed of polyamide and is formed by a blow molding process or by rotary sintering. These production processes are conventional so that they will not be detailed here. The first casing or liner 12 is reinforced on the outer peripheral side by a fiber winding wound on from the outside as the second plastic casing 14. For example, the reinforcing winding is a fiber reinforcement such as carbon fibers, aramid fibers, gas fibers, boron fibers, $Al_2O_3$ fibers or of mixtures thereof, which are also called hybrid yarns embedded in a basic matrix of duromers, for example epoxy or phenolic resins or in thermoplastics, for example, in the form of PA 12, PA6, PP, etc. The fiber composite material forming the support jacket in this respect contains fiber strands embedded in the plastic resin, crossing one another, and extending essentially in the longitudinal and peripheral direction. The fiber composite material forming the support jacket can in addition or alternatively also comprise fiber strands crossing one another and tilted in the longitudinal and peripheral direction, In one advantageous development of the longitudinal axis of the plastic core container, the fiber strands can be tilted in mirror image. The forces directed longitudinally and peripherally can be optimally accommodated by the pressurized container in this way. Moreover, the possibilities are improved for adjusting the ratio of the opening cross section of a face-side opening with reference to the inside diameter of the plastic core container to large values of at least 30%, preferably of at least 50%, without adversely affecting operation.

On its opposing ends the first plastic casing 12 ends in one cylindrical collar part 16. For an embodiment not shown it would also be conceivable to close one end of the first plastic casing 12 and to provide only one collar part 16. The pressurized container is made essentially rotationally symmetrical and extends along its center periphery 18 with a coaxial arrangement of its two casings 12, 14 along its longitudinal axis 20. Viewed in the direction of this longitudinal axis 20, the free end of the second plastic casing 14 ends above or axially beyond the collar part 16 of the first plastic casing 12. This arrangement has proven favorable for the forces to be delivered during operation of the container. The collar part 16 of the first plastic casing 12 and the second plastic casing 14 are otherwise supported on the outside support ring 22 lying between them. The outside support ring 22 tapers in the direction of the gap opening 24 between the casings 12, 14 in the manner of a wedge. The gap opening 24 between the casings 12, 14 is routed as far as and extends to the location at which the casings 12, 14 are in a coaxial arrangement to the longitudinal axis 20 of the accumulator and are in contact with one another. The wedge-shaped taper 26 of the outside support ring 22 extends as far as this site. The outside support ring is either made in one piece (not shown), or as shown in FIG. 1 is composed of at least two annular individual segments 28, 30 of metal.

As also shown in FIG. 1, the outside contour 32 of the outside support ring 22 in the direction of the gap opening 24 is provided with a convex curvature. The opposite inside contour 34 of outside support ring 22 extends, proceeding from the gap opening 24, in a straight slope ending at the site of the entry of the collar part 16 in a contact surface parallel to the longitudinal axis 20 of the container. The curvature of the outside contour 32 increases in the direction of the free end of the second plastic casing 14. This inside and outside contour configuration for the outside support ring 22 ensures good delivery of force and reliable coupling of the plastic casings 12, 14 in the region of the outside support ring 22. If the outside support ring 22, as shown, has individual metallic segments, at least one of the two individual segments 28 or 30 in the edge-side region can have a projection ending in the manner of an overlap in an edge-side radial depression of the other individual segment. In this way especially good adhesion of the two individual segments to one another is possible. Viewed in cross section as shown in FIG. 1, one individual segment 30 is made in the manner of a feed edge and the other individual segment 28 as far as the free end of the respective collar part 16 is made in the manner of a parallelogram.

The collar part 16 of the first casing 12 is supported on the inner peripheral side on another contact surface of the inside support ring 36 likewise made as a rigid metal ring. As FIG. 1 shows, the inside support ring 36 need not be made identical for the two ends of the pressurized container. A characteristic that the respective inside support ring 36 along its outer peripheral surface has an annular groove for holding the O-ring 38 used to seal the respective delivery and discharge of the medium. Furthermore, the inside support ring 36 is supported in the outside support ring 22 such that a common boundary wall for the delivery and discharge of the medium is formed. The illustrated inside support ring 36 in the direction of the interior of the pressurized container is provided with a contact bevel having a tilt matched to the tilt of the bevel of the inside contour 34 of the outside support ring 22 and corresponding especially to it. The outside contour 32 of the outside support ring 22 is provided with a ring-shaped recess 40 in the respective end of the second plastic casing 14 ends with contact.

On both sides of the center periphery 18, the second plastic casing 14 has a least one additional winding layer 42 helping to increase the bursting pressure and ensuring that in case of bursting any solid internal parts of the pressurized container or accumulator cannot be shot to the outside. Rather, they are retained by the additional winding layer 42. Depending on the overall length of the accumulator, this additional winding layer 42 may be present only once or repeatedly at discrete distances from one another. The outside support ring 22 is able to uniformly distribute the stress peaks occurring in the manner of a pressure buffer and to deliver them into the two plastic casings 12, 14. In this way, bulging of the pressurized container is effectively avoided. Since in the sense of sliding motion in the coaxial region, extremely small delaminating relative movements can occur between the facing sides of the plastic casings 12, 14, it is sufficient in this respect to undertake support and separation of the layers or of the two casings 12, 14 from one another in the end-side enclosure region by the outside support ring 22. The illustrated cross sectional wedge shape of the outside support ring 22 is favorable to the extent it effectively counteracts the relative displacements, for which the different configuration of the outside contour 21 to the inside contour 34 acts at the same time in a supportive manner. In spite of the circumstance that for the described pressurized container design only smooth surfaces are used, especially relative to the inside support ring 36 and the outside support ring 22, it is surprising that in this way a high-strength and stiff connecting part in the region of the collar part 16 is achieved in a structurally simple manner.

While one embodiment has been chosen to illustrate the invention, it will be understood by those skilled in the art that various changes and modifications can be made therein without departing from the scope of the invention as defined in the appended claims.

What is claimed is:

1. A pressurized container for holding at least one fluid medium, comprising:

a first plastic casing including a first end having a collar part with an opening for delivery and discharge of a medium, including a first tapered part extending from said collar part and including a cylindrical part extending from said first tapered part thereof;

a second plastic casing at least partially encompassing said first plastic casing including a first end with a first opening, a first tapered part extending from said first opening thereof and a cylindrical part extending from said first tapered part thereof;

a gap opening extending and tapering between said first and second plastic casings from said collar part and ending at a site where said first and second plastic casings are in contact and are coaxial with one another; and an outside support ring interposed and supported on said collar part and said second plastic casing in said gap opening and tapering in a wedge shape in a direction of said gap opening and in a direction of and extending as far as said site, said outside support ring having at least one piece, having an outside contour with a convex curvature relative in a direction of said gap opening and having an inside contour proceeding from said gap opening and extending in a straight slope ending in a contact surface parallel to a longitudinal axis of the first and second plastic casings at an entry site of said collar part.

2. A pressurized container according to claim 1 wherein said outside support ring comprises at least two annular individual segments of metal.

3. A pressurized container according to claim 1 wherein said collar part of said first plastic casing is supported on an inner peripheral side thereof on a contact surface of an inside support ring, said inside support ring being a rigid metal ring.

4. A pressurized container according to claim 3 wherein said inside support ring is supported inside said outside support ring with a common boundary wall of said inside and outside support rings for delivery and discharge of the medium.

5. A pressurized container according to claim 4 wherein said inside support ring has a contact bevel facing an interior of said first plastic casing and having a tilt corresponding to a tilt of a bevel of said inside contour of said outside support ring.

6. A pressurized container according to claim 3 wherein said inside support ring has a contact bevel facing an interior of said first plastic casing and having a tilt corresponding to a tilt of a bevel of said inside contour of said outside support ring.

7. A pressurized container according to claim 1 wherein said outside contour of said outside support ring comprises a ring-shaped recess receiving and contacting said first end of said second plastic casing.

8. A pressurized container according to claim 1 wherein said first plastic casing is a plastic liner produced by one of a blow molding process, a rotary molding process and a thermal molding process.

9. A pressurized container according to claim 1 wherein said second plastic container comprises a winding of at least one fiber and forms a fiber reinforcement for said first plastic casing where said first and second plastic casings contact.

10. A pressurized container according to claim 9 wherein said second plastic casing comprises additional winding layers at discrete distances from one another.

* * * * *